United States Patent [19]

Lautenschläger et al.

[11] 4,397,064

[45] Aug. 9, 1983

[54] CABINET HINGE

[75] Inventors: Horst Lautenschläger, Reinheim; Gerhard W. Lautenschläger, Brensbach-Wersau, both of Fed. Rep. of Germany

[73] Assignee: Mepla, Inc., High Point, N.C.

[21] Appl. No.: 281,307

[22] Filed: Jul. 8, 1981

[51] Int. Cl.[3] ..... E05D 7/04; E05D 5/02

[52] U.S. Cl. ..... 16/379; 16/380; 403/231; 312/280

[58] Field of Search ..... 312/280, 282, 111, 140, 312/296; 16/379, 380, 248, 246, 245, 235, 233, 242, 333; 403/12, 231, 407

[56] References Cited

U.S. PATENT DOCUMENTS

| | | | |
|---|---|---|---|
| 2,628,531 | 2/1953 | Wright | 16/379 |
| 2,839,778 | 6/1958 | Hutchinson et al. | 16/245 |
| 3,146,486 | 9/1964 | Hoffman | 16/242 |
| 3,545,712 | 12/1970 | Ellis | 403/231 |
| 4,007,513 | 2/1977 | Zernig | 16/333 |
| 4,099,293 | 7/1978 | Pittasch | 403/231 |
| 4,127,353 | 11/1978 | Busse | 403/407 |
| 4,131,376 | 12/1978 | Busse | 403/12 |
| 4,159,557 | 7/1979 | Pittasch et al. | 16/242 |
| 4,207,652 | 6/1980 | Lautenschlager | 16/248 |
| 4,272,207 | 6/1981 | Lautenschlager | 403/231 |

FOREIGN PATENT DOCUMENTS

| | | | |
|---|---|---|---|
| 246367 | 8/1965 | Austria | 16/379 |

*Primary Examiner*—Victor N. Sakran

[57] ABSTRACT

A hinge for pivotally mounting a door leaf on a cabinet with a box-like carcass having one open side, narrowed by a frame formed by strip-like frame members projecting each at right angles from a carcass wall toward an opposite carcass wall. The hinge has a door-leaf-related hinge part fastenable sunkenly in the back of the door leaf and, a frame-related hinge part which is pivotingly coupled by a link mechanism with the door-related hinge part. The frame-related part has a mounting piece fitted and mounted into the frame member recess and a block jointed by the link mechanism to the door-leaf-related hinge part and displaceably disposed in this recess parallel to the front side of the frame and at right angles to the end face of the corresponding frame member. The block is joined to the mounting part by a screw element whose threaded shank is in engagement with a counter-thread in the block and is held in the mounting piece rotatably but undisplaceably in the longitudinal direction of the shank.

12 Claims, 4 Drawing Figures

CABINET HINGE

BACKGROUND

The invention relates to a hinge for mounting a door on a cabinet having a box-like carcass open on one side, in which the size of the opening is reduced by a frame formed of stick-like frame members in which the door lies against the frame when in the closed position, and the hinge has a door-related part which can be fastened in a rebate in the back of the door, and a frame-related part coupled to the door-related part by a link mechanism and disposed in a rebate cut in the face of the frame member.

A hinge of this kind is described in the inventors' earlier U.S. patent application Ser. No. 230,268 filed Jan. 30, 1981, in which, in addition to the possibility of the adjustment of the door leaf for height, i.e., adjustment parallel to the pivot axis of the hinge, the possibility is created for an adjustment also permitting the amount of overlap of the door when closed against the frame to be varied by making the door-related part to consist of a plurality of parts, the part holding the link mechanism being adjustable in the desired direction relative to the part affixed to the door.

The hinge of the invention likewise has to do with the problem of the adjustment of the amount of overlap of the door, but, in a departure from the above-mentioned earlier proposal of the inventors, this possibility of adjustment is to be accomplished in the frame-related part, that is to say, a positive, continuous adjustability of the amount of overlap of the door is to be achieved without creating the danger that, during the adjustment, the parts to be moved with respect to one another might shift accidentally, making a readjustment necessary. Furthermore, it is also to be possible to remove the door from the carcass and reinstall it thereon in a quick and simple manner, without the need to remove the frame-related part entirely from the cabinet carcass or the door-related part entirely from the door.

Setting out from a hinge of the kind specified above, this object is achieved in accordance with the invention by the fact that the frame-related part of the hinge has a mounting piece fitted into the rebate in the frame member and fastened therein, and provided with a recess and a block which is joined by the link mechanism to the door-related part of the hinge and is disposed in this recess so as to be displaceable parallel to the face side of the frame and at right angles to the edge of the corresponding frame member, and by the fact that the block is adjustable in the mounting piece by a screw-threaded element whose threaded shank is in engagement with a corresponding thread in the block and is held in the mounting piece so as to be able to rotate but not to be displaced longitudinally. Therefore, by turning the screw-threaded element which is engaged with the block, the amount of the door overlap can be positively adjusted. Since the thread engagement is self-locking, any adjustment that is made will also be held, so that no additional fixing of the block in the mounting piece is necessary.

The block is best guided positively in its displacement by slot-and-key joints provided between the confronting lateral surfaces of the block on the one hand and of the recess on the other, a key preferably extending from each lateral surface of the block into the slot in the confronting surface of the mounting piece. Alternatively, the reverse arrangement can also be used, i.e., one in which the keys are provided on the mounting piece and the slots in the lateral surfaces of the block.

In an advantageous further development of the invention, the screw-threaded element is a threaded spindle disposed in a bore formed partially in the block and partially in the mounting piece in the plane of separation between one lateral surface of the block and the associated lateral surface of the mounting piece, and having its thread interrupted by a circumferential groove which is engaged by a projection of the otherwise smooth bore portion formed in the mounting piece, while the bore portion in the block is provided with a thread complementary to the thread of the spindle.

To assure that the spindle will be held securely in the mounting piece even if the block is completely removed therefrom, it is desirable to offset the longitudinal central axis of the bore accommodating the spindle slightly into the mounting piece, away from the plane of separation between the confronting surfaces of the block and mounting piece, so that the plain wall of the bore portion formed in the mounting piece will extend more than 180° around the circumference of the spindle, while the threaded bore portion provided in the block will engage the thread of the spindle over less than 180° of the latter's circumference.

When the spindle is installed, the projection that is to hold it in the bore portion in the mounting piece must not be present, since otherwise the spindle could be inserted only to the depth at which its end engages this projection. The installation of the spindle, however, is made possible in accordance with the invention by the fact that the projection is formed by tip of a pin inserted or pressed into the bore portion through a bore in the wall of the mounting piece, this pin being installed after the spindle is installed in the bore portion.

If the spindle is rotated sufficiently, it can lift the block all the way out of the mounting piece, i.e., a door mounted with the hinge of the invention can be removed from the cabinet carcass in this manner. This method of removal is impractical, however, because the turning of the spindle, which would have to be performed separately on at least two hinges, would be relatively time-consuming, and it would have to be done more or less evenly to prevent the blocks from cocking and jamming in the mounting pieces. The removal of the block is accomplished more simply and quickly in a further development of the hinge of the invention, in which the width of the block, as measured transversely of its adjusting travel and longitudinally of the door frame member is less than the width, measured in the same manner, of the recess in the mounting piece, so that the block is held in the mounting piece with sufficient clearance so that, by moving it from side to side, it can be engaged or disengaged from the threaded spindle, means being provided which can serve to engage and disengage the block from the spindle. As soon as the block is out of engagement with the threads of the spindle, it can simply be removed from the mounting piece.

In a preferred further development of the invention, the means holding the block in engagement with the threaded spindle comprise a cylinder-head screw which can be threaded into the face of the block on the side opposite the threaded bore portion, and a planar guiding surface is provided on the mounting piece and extends in the direction of adjustment; the cylindrical surface of the screw head engages this guiding surface when the screw is driven all the way in, and secures the block against lateral displacement out of engagement with the threaded spindle. The cylindrical surface of the screw head therefore takes up the clearance between the block and the mounting piece when it is engaged with the guiding surface. When the screw is withdrawn until the screw head is backed away from the guiding surface, the screw will no longer take up this clearance.

Between the cylindrical screw head and the threaded shank of the screw, a truncoconical transition can be provided, which will wedge the block into threaded engagement with the spindle as the screw is driven in.

In addition, the guiding surface associated with the cylindrical head of the screw can merge with a ramp surface disposed at an angle to the guiding surface which corresponds to the cone angle of the truncoconical transition on the screw. By tightening the transitional section of the screw against this ramp surface, a wedge action is produced which will grip the block tightly in the mounting piece.

In further development of the invention, an elongated hole extending in the direction of displacement of the block can be provided in the wall defining the bottom of the recess in the mounting piece, and the free end of the threaded shank of the screw can be engaged in it, the threaded shank of the screw being at least long enough to enter the elongated hole before the screw is driven all the way in. The free end of the threaded shank of the screw thus forms a stop—as long as it projects from the block into the elongated hole—which prevents any unintentional separation of the block from the mounting piece.

The invention will be further explained by means of the following description of one of its embodiments, in conjunction with the drawing, wherein.

Figure 1:
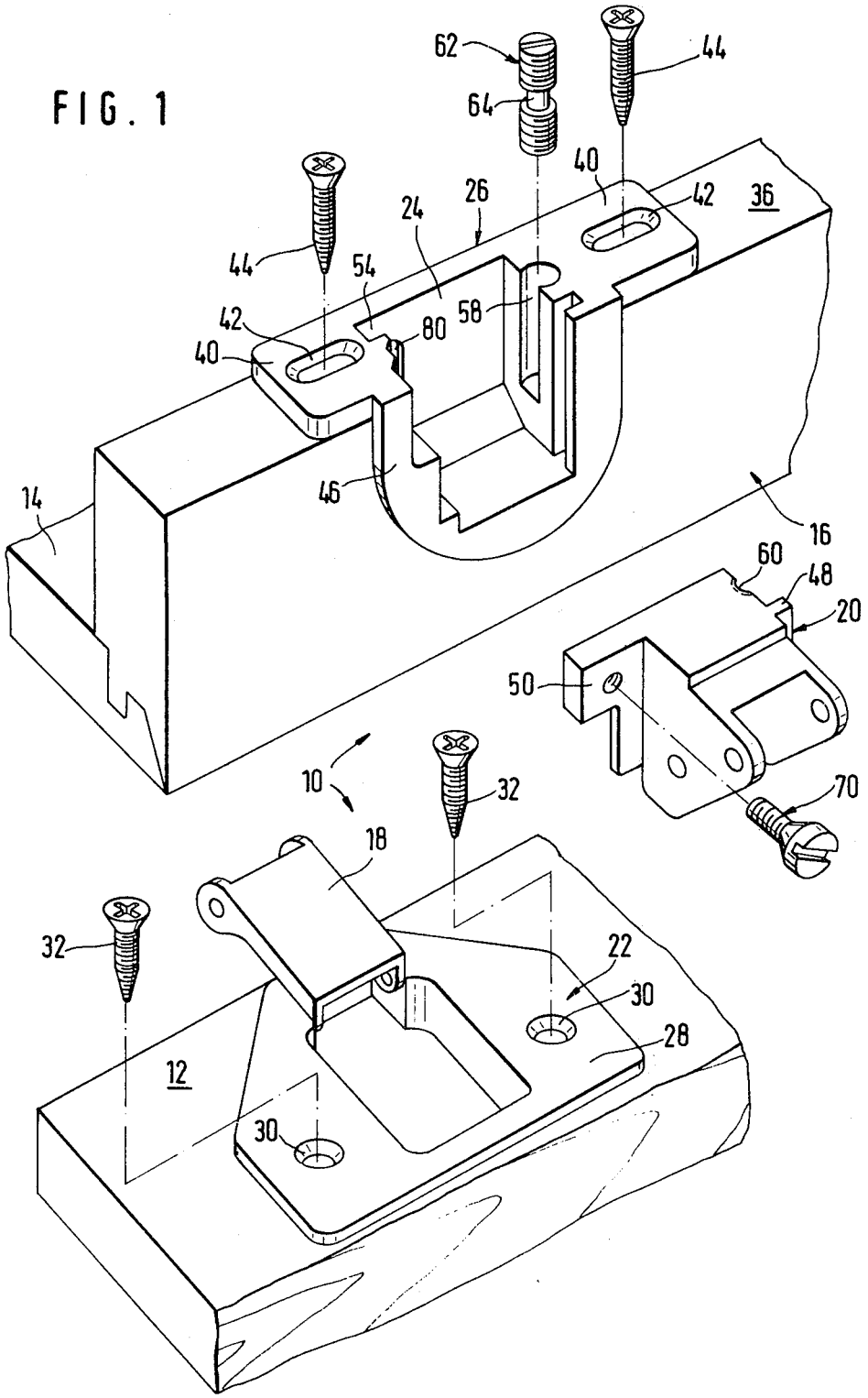
FIG. 1 is an exploded and partially disassembled perspective view of a link hinge fastened on the one hand to a doorframe member of a cabinet and on the other to a door.

FIG. 1 shows a four-joint hinge identified as a whole by the number 10, which serves for the pivotal mounting of a door 12 to a door frame member 16 projecting from one wall 14 of the carcass of a cabinet, and it shows the cabinet door-related part 22 of the hinge, which in the assembled state ordinarily is pivotingly attached to a block 20 by the hinge link 18 and an additional hinge link which is concealed by the hinge link 18 and therefore invisible, separated from the block 20 and represented in an exploded manner for greater ease of comprehension. The block 20, which is ordinarily mounted in a recess 24 of a mounting piece 26 fastened to the frame member 16 so as to be displaceable and fixable in selected positions, and which with the mounting piece constitutes the frame-related part 34 of the hinge, is shown removed and separated from the mounting piece 26, the method of representation being, for reasons of space, as if the door leaf 12 were opened by pivoting it forward about a horizontal axis like the writing leaf of a secretary, and is closed by pivoting it upward. In the case of door leaves which are hinged so as to turn about a vertical axis on a vertical cabinet frame member, the drawing is to be considered as if the vertical frame member were rotated to a horizontal position.

The door-related part 22 has the conventional form of a cup which can be inserted into a rebate in the door 12. In the illustrated case the cup has a flange 28 projecting beyond the actual cup and lying against the inside surface of the door 12. Two beveled screw holes 30 are provided in the door-related part 22, and two mounting screws 32 can be passed through them and driven into the door leaf 12 thereby fastening the cup to the door.

The frame-related hinge part 34, which, as stated, is composed of the mounting piece 26 and the block 20, is disposed in a rebate 38 which is cut into the front face and edge 36 of the frame member 16, and, as seen from the front, is of a roughly semicircular shape; this rebate can either be cut all the way through from the front to the back of the frame member or, preferably, from the front face of the frame through part of the thickness of the frame member, so that the rebate 38, therefore, will be closed off from the interior of the cabinet. The door-frame-related part 34 is fastened to the door frame member 16 by means of the mounting flange 40 projecting laterally from the mounting piece 26 and lying flatly against the edge 36. For this purpose, elongated holes 42 are provided in the mounting flanges 40, and extend longitudinally of the frame edge 36, and mounting screws 44 can be passed through them and driven into the edge of the frame member 16. To permit an adjustment or shift of the frame-related part 34 longitudinally of the frame member 16, the portion of the frame-related part 34 that lies within the recess 38, i.e., the mounting piece 26, is made smaller in the direction of adjustment than the recess 38, so that the frame-related part can be shifted lengthwise of the frame member after the mounting screws 44 have been loosened. The mounting piece 26 of the frame-related part 34 of the hinge has on its side facing the door leaf 12 a thin flange 46 set flatly against the face of the frame member, so as to conceal the otherwise undesirably visible gaps between the wall of the rebate and the portion of the frame-related part that lies within the rebate, and also establishes the depth to which the frame-related part is set into the front face of the frame member 16, which is to be considered as the reference surface.

The block 20 is, as stated above, displaceable in the recess 24 of the mounting piece 26, the recess being open at its top and front sides, as seen in the drawing, and the block is displaceable in a plane parallel to the front face of the frame member and at right angles to the face of the flange 40.

For this purpose, the block 20 is installed in the recess 24 of mounting piece 26 by means of slot-and-key joints constituted by keys 48 and 50 on the block and corresponding slots 52 and 54 in the side walls of the recess 24.

In back of the slot-and-key joint 48, 52, a bore 56 is provided in the frame-related part 34, the central axis of the bore being in a plane parallel with but offset from the plane of the separation between the side walls of the recess 24 and the sides of the insert 20, such that the bore 56 is made up of a bore portion 58 in the mounting piece 26 and a bore portion 60 in the insert 20. Since the longitudinal central axis of bore 56 is within bore portion 58 in mounting piece 26, bore portion 58 is relatively deep and bore portion 60 is relatively shallow. In the bore 56 there is disposed a threaded spindle 62 whose thread is interrupted approximately in the center by a circumferential groove 64 wherein the originally continuous threading has been cut away. This circumferential groove 64 is engaged by the inner end of a pin 66 pressed through the wall of the mounting piece 26 into the bore portion 58, thus holding the spindle 62 against longitudinal displacement in bore portion 58, but allowing it to be rotated. Bore portion 60 in the block, however, is not plain like the bore portion 58, but has a thread complementary to the thread of spindle 62. When the spindle is turned, therefore, the block 20 is continuously and positively displaced in the recess 24 and thus also changes the relative position of the door-related hinge part 22 coupled by the link mechanism to the block, and thus changes the overlap of door leaf 12 on the face side of the frame member 16.

Figure 2:
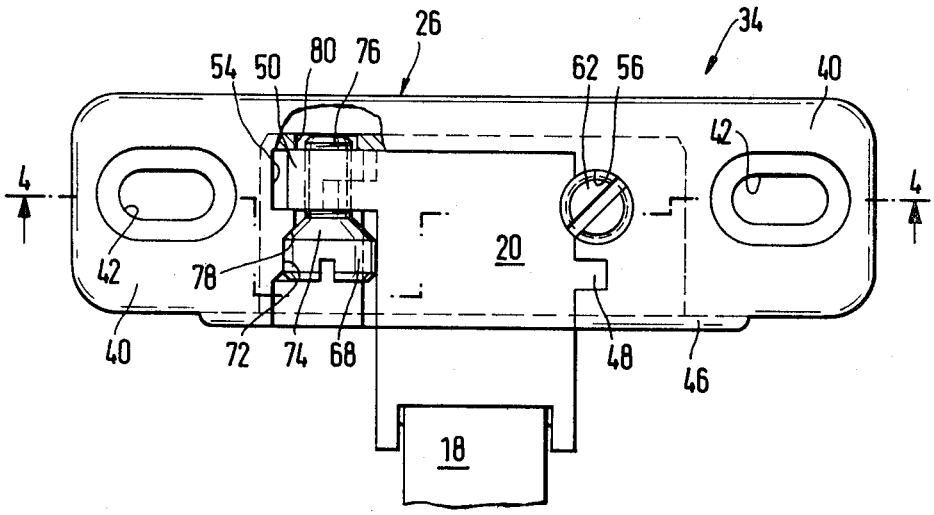
FIG. 2 is a plan view of the door-frame-related part of the hinge, which is composed of a mounting piece and a block displaceably disposed in this mounting piece, showing the block affixed thereto.
Figure 3:
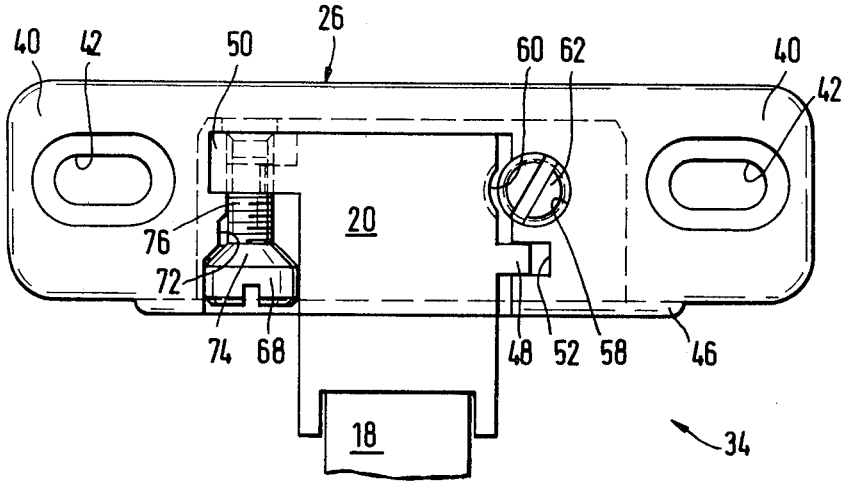
FIG. 3 is a plan view like FIG. 2 of the cabinet-door-frame-related part of the hinge showing the block in position for removal from the mounting piece.
Figure 4:
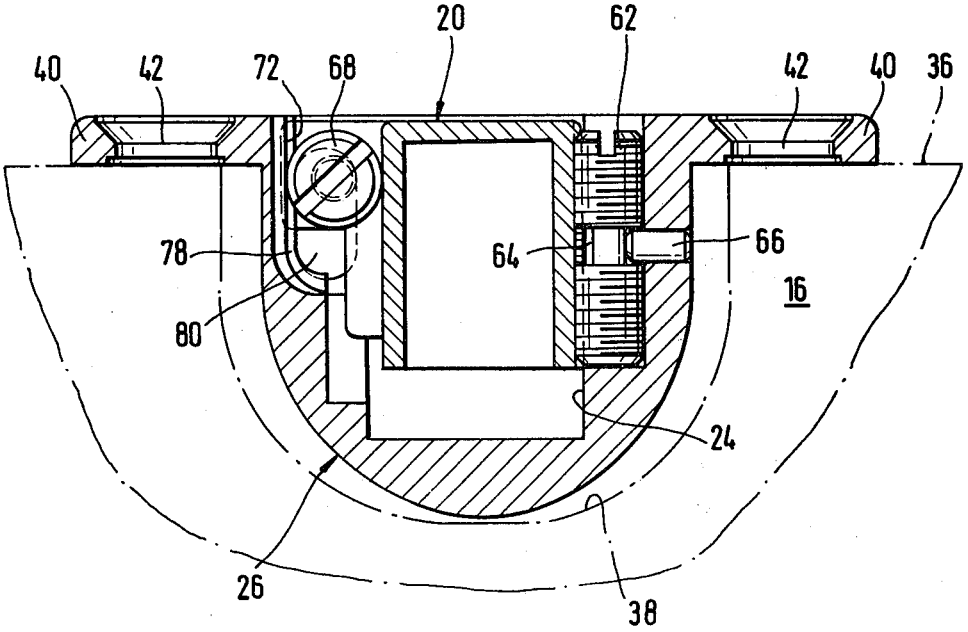
FIG. 4 is a cross-sectional view through the cabinet-door-frame-related part of the hinge of the invention, as seen in the direction of the arrows 4—4 of FIG. 2.

As seen especially in FIGS. 2 and 3, the width of block 20 is slightly smaller than the width of the recess 24 in the mounting piece 26, so that consequently the block has a free play which is so great that the thread in the bore portion 60 can be disengaged from the thread of the spindle 62. Such disengagement from the bore portion 60 is represented in FIG. 3; it is apparent that, when the block is in this position, it can easily be withdrawn from the recess 24.

Normally, however, on the side of the block 20 opposite that of the threaded bore portion 60, the block is held in engagement with the spindle 62 by the cylindrical circumferential surface of the screw head 68 of a screw 70 threaded from the front side into a tap in key 50. This is because the cylindrical circumferential surface of the screw head 68 is associated with a planar guiding surface 72 of the mounting piece 26, which extends in the direction of the block adjustment, and which is engaged by the cylindrical circumferential surface of the head 68 of the screw 70 when the latter is turned all the way in, and secures the block 20 against lateral displacement disengaging its threads from the spindle 62. This secured position is shown in FIG. 2. By withdrawing the screw 70 to the position shown in FIG. 3, in which the screw head 68 is in a widened portion of the recess 24 in front of the guiding surface 72, the block can be released easily and quickly. That is, whenever a door mounted on a cabinet carcass by the hinge 10 is to be removed from the carcass, the screws 70 of the hinges 10 are withdrawn only a few turns sufficient to disengage the screw heads 68 from the guiding surfaces 72. Then the door 12 can be withdrawn—together with the door-related parts 22, the linkage mechanism and the inserts 20—out of the mounting pieces 26 which then remain on the frame member 16. To reinstall the door 12, this sequence of operations is simply reversed.

The cylindrical screw head 68 is joined to its threaded portion by a truncoconical transition 74. This transition 74 is associated with a ramp surface 78 adjoining the guiding section 72. By driving screw 70 inwardly until the transition 74 is in tight engagement with the ramp surface 78, the block 20 can be locked rigidly in the recess 24 of the mounting piece 26.

A hole 80 elongated in the direction of the displacement of the block is provided in the rear wall of mounting piece 26 so as to be engaged by the free end of the threaded portion 76 of the screw, not only when the screw is driven all the way in but also when it is slightly loosened. The threaded shank 76, therefore, forms in conjunction with the elongated hole 80 a limiting stop for the block 20 during the normal adjustment by means of the spindle 62.

We claim:

1. For use in a cabinet having a box-like carcass with carcass walls, and having an open side narrowed by a frame formed by strip-like frame members projecting each at right angles from one of the carcass walls toward an opposite carcass wall, at least one recess in one of the frame members, said carcass being open from front to back of the frame member and cut from the free front face of the frame member in the direction of the adjacent carcass wall: a hinge for pivotally mounting a door leaf to said cabinet, said hinge comprising: a door-leaf-related hinge part fastenable sunkenly in an opening in the back of the door leaf, a frame-related hinge part, and a link mechanism pivotingly coupling said hinge parts, said frame-related hinge part having a mounting piece to be fitted and mounted into the frame member recess, and a block joined by said link mechanism to said door-leaf-related hinge part and to be displaceably disposed in the recess parallel to the front side of the frame and at right angles to the end face of the frame member, slot and key joints provided between confronting lateral defining surfaces of said block and said mounting piece, whereby said block is guided for longitudinal displacement in the mounting piece, and a screw element joining said block to the mounting part, said element having a threaded shank in engagement with a counter-thread in said block and held in said mounting piece rotatably, but nondisplaceably in the longitudinal direction of said shank, said screw element being a threaded spindle disposed in a bore formed partially in said block and partially in said mounting piece and laid across the plane of separation between the lateral defining surface of the block and said confronting defining surface of said mounting piece, a circumferential groove interrupting the thread of the threaded shank of the spindle, and a projection protruding from a plain bore portion formed in said mounting piece and engaging said groove, and a bore portion in said block and provided with a counter-thread complementary to the thread of the threaded spindle.

2. A hinge according to claim 1, wherein said block has on its lateral defining surfaces projecting keys disposed in the direction of the displacement, each engaging an associated slot in the confronting defining surface of the mounting piece.

3. A hinge according to claim 1, wherein the longitudinal axis of the bore receiving the threaded spindle is, with respect to the plane of separation between the lateral defining surfaces of said block and of said mounting piece, offset slightly into said mounting piece, so that the plain circumferential wall of the bore portion formed in said mounting piece reaches around the threaded spindle over more than 180° in the circumferential direction, while the bore portion of said block provided with the counter-thread is in engagement with the thread of said spindle over less than 180° in the circumferential direction.

4. A hinge according to claim 1 or 3, wherein said projection in the bore portion associated with said mounting piece and engaging the circumferential groove of said spindle is formed by the protruding end of a pin inserted or pressed through a bore in the wall of said mounting piece into the bore portion.

5. A hinge according to claim 1 or 3, wherein the width of said block, measured transversely of the direction of adjustment, in the longitudinal direction of the frame member, is narrower, by at least the engagement dimension of the threads of the threaded spindle with the threads of the block bore portion, than the width of the recess measured in the same direction, so that said block is held in the transverse direction with such clearance in said mounting piece that by transverse displacement it can be placed in or out of thread engagement with said threaded spindle, and removable holding means for holding said block in thread engagement with said threaded spindle.

6. A hinge according to claim 4, wherein the width of said block, measured transversely of the direction of adjustment, in the longitudinal direction of the frame member, is narrower, by at least the engagement dimension of the threads of the threaded spindle with the threads of the block bore portion, than the width of the recess measured in the same direction, so that said block is held in the transverse direction with such clearance in said mounting piece that by transverse displacement it can be placed in or out of thread engagement with said threaded spindle, and removable holding means for holding said block in thread engagement with said threaded spindle.

7. A hinge according to claim 5, wherein said holding means includes a screw having a cylindrical screw head adapted to be driven from the front side of the block on the side of the block opposite that of the threaded bore portion, and a planar guiding surface on said mounting piece and extending in the direction of adjustment, and which is engaged by the cylindrical circumferential surface of the screw head of the fully driven screw, and secures the block against lateral displacement out of thread engagement with the threaded spindle.

8. A hinge according to claim 6, wherein said holding means includes a screw having a cylindrical screw head adapted to be driven from the front side of the block on the side of the block opposite that of the threaded bore portion, and a planar guiding surface on said mounting piece and extending in the direction of adjustment, and which is engaged by the cylindrical circumferential surface of the screw head of the fully driven screw, and secures the block against lateral displacement out of thread engagement with the threaded spindle.

9. A hinge according to claim 7, wherein a truncoconical transition section is provided between the cylindrical screw head and the threaded shank of the screw.

10. A hinge according to claim 8, wherein a truncoconical transition section is provided between the cylindrical screw head and the threaded shank of the screw.

11. A hinge according to claim 9, wherein said guiding surface merges with a wedge surface disposed at an angle to the guiding surface corresponding to the cone angle of the transitional section of the screw.

12. A hinge according to claim 10, wherein said guiding surface merges with a wedge surface disposed at an angle to the guiding surface corresponding to the cone angle of the transitional section of the screw.

* * * * *